US006550828B2

(12) United States Patent
Warden

(10) Patent No.: US 6,550,828 B2
(45) Date of Patent: Apr. 22, 2003

(54) DOOR GAP APPARATUS

(76) Inventor: Monty K. Warden, 736 NW 92nd St., Oklahoma City, OK (US) 73114

( * ) Notice: Subject to any disclaimer, the term of this patent is extended or adjusted under 35 U.S.C. 154(b) by 0 days.

(21) Appl. No.: 09/954,100

(22) Filed: Sep. 17, 2001

(65) Prior Publication Data

US 2002/0033608 A1 Mar. 21, 2002

Related U.S. Application Data

(60) Provisional application No. 60/233,240, filed on Sep. 18, 2000.

(51) Int. Cl.[7] ..... E05C 19/18
(52) U.S. Cl. ..... 292/288; 292/262
(58) Field of Search ..... 292/288–298, 292/262, 339, 342, 343; 16/82

(56) References Cited

U.S. PATENT DOCUMENTS 2,618,497 A * 11/1952 Gardels ..... 292/265
3,181,319 A * 5/1965 Hudon ..... 70/14
3,593,996 A * 7/1971 Thompson ..... 272/62
3,758,141 A * 9/1973 Weinberger ..... 292/262
4,012,065 A * 3/1977 Miller ..... 292/288
4,019,764 A * 4/1977 Okamura ..... 292/288
4,560,192 A * 12/1985 Wilson ..... 292/339
4,653,785 A * 3/1987 Tobey ..... 292/258
4,712,816 A * 12/1987 Mueller ..... 292/253
4,982,474 A 1/1991 Kjellström
5,027,471 A 7/1991 Barnes
5,123,685 A 6/1992 Donovan
5,531,490 A 7/1996 Parker
5,581,844 A 12/1996 Raheb et al.

* cited by examiner

*Primary Examiner*—Gary Estremsky

(57) ABSTRACT

A door gap apparatus is provided for mounting on a door and extends from the door to a door frame. The door gap apparatus includes a door clamp which includes a door-edge-covering portion and a pair of door-side clamp portions extending outward from the door-edge-covering portion at opposite edges of the door-edge-covering portion. The door-side clamp portions extend from the door-edge-covering portion in a first direction. Panel clamp members are attached to the door-edge-covering portion and extend outward from the door-edge-covering portion in a second direction which is perpendicular to the first direction. The panel clamp members are spaced apart providing a panel-reception region therebetween. A panel portion fits between the panel clamp members. The rectangular or triangular panel portion extends in the second direction, providing a gap between the door and the door frame.

6 Claims, 6 Drawing Sheets

FIG 2
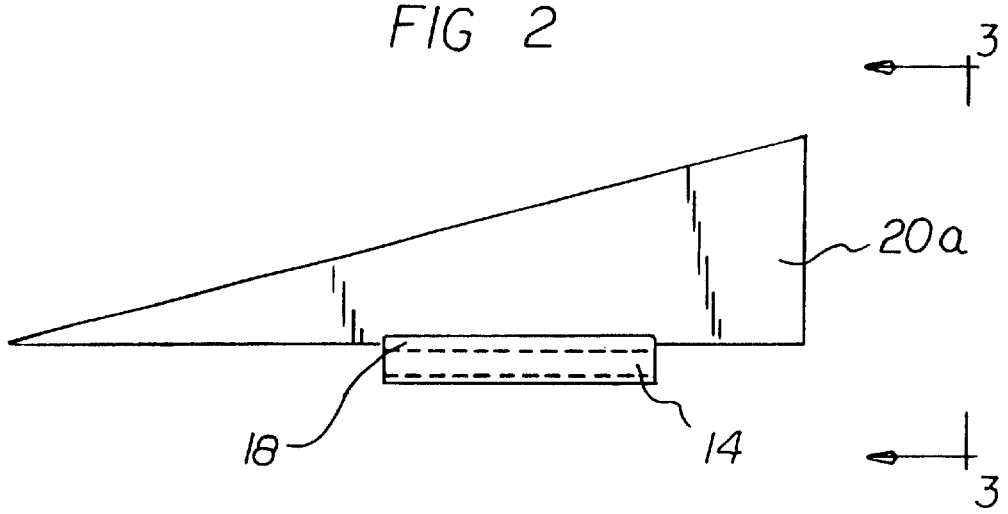
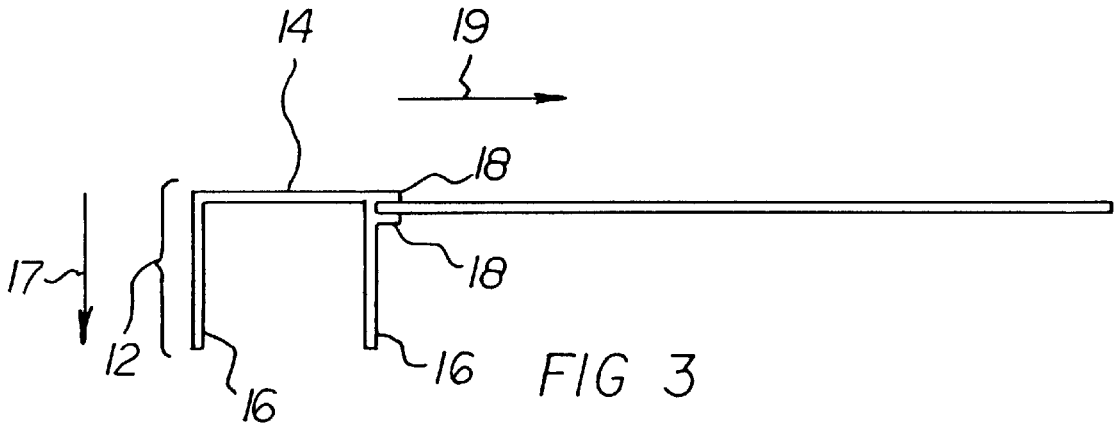
FIG 3

FIG 6
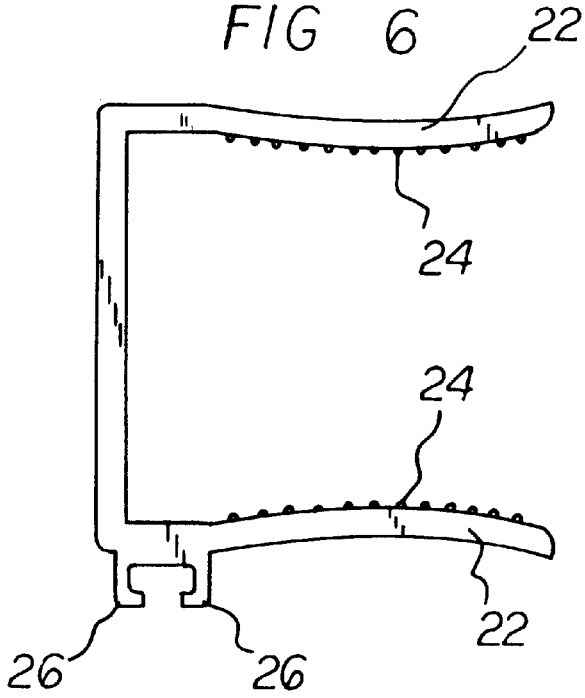
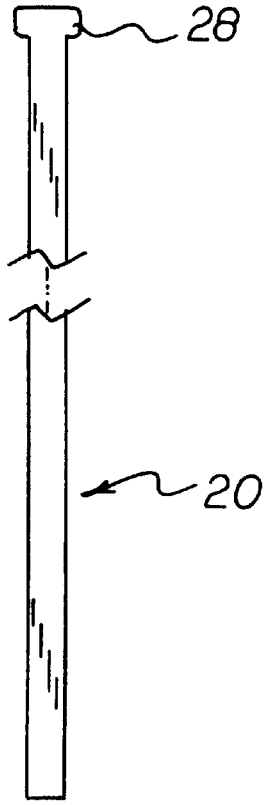
FIG 7

DOOR GAP APPARATUS

CROSS-REFERENCE TO RELATED APPLICATION

This application claims priority based upon my Provisional Application Serial No. 60/233,240, filed Sep. 18, 2000.

BACKGROUND OF THE INVENTION

1. Field of the Invention

The present invention relates generally to devices connected to doors and, more particularly, to devices especially adapted for providing a gap by retaining a door partially opened with respect to a surrounding door frame.

2. Description of the Prior Art

It is well known in the art to maintain a door is a partially opened condition with respect to a door frame. It may be desirable to retain a door in a partially opened condition for a number of reasons. One reason is permit ventilation without permitting a person to enter a room. Another reason is permit sounds in a room to be more easily heard than if a door were completely closed. This may be especially important when an infant is in a room. A partially opened door may also be used to permit a pet to enter and leave a room without permitting a person to do the same.

Throughout the years, a number of innovations have been developed relating to retaining a door in a partially opened condition, and the following U.S. patents are representative of some of those innovations: U.S. Pat. Nos. 4,982,474, 5,027,471, 5,123,685, 5,531,490, and 5,581,844.

More specifically, U.S. Pat. No. 4,982,474 discloses a door blocking device which includes a portion permanently attached to door. A temporary use door stop is attached by a hinge to the door. To avoid the need to permanently attach a partially opened door retainer it would be desirable if a door gap apparatus were provided which is not permanently attached to a door.

U.S. Pat. No. 5,027,471 discloses a door prop that has a portion which is in direct contact with a door hinge. Care must be employed to assure that accurate positioned of the door prop with respect to the door hinge is accomplished. To avoid the need to carefully place a door prop next to a door hinge, it would be desirable if a door gap apparatus were provided that does not require that the apparatus be accurately positioned next to a door hinge.

U.S. Pat. No. 5,123,685 discloses a door stop that is used for keeping a door ajar. The door stop is mounted on the door and includes a plurality of selectable abutment legs for selecting the degree of openness at which the partially opened door is to be maintained. When one selected abutment leg is to be used, nonselected abutment legs are merely carried a bracket attached to the door. Abutment legs that are carried by the door but not used add extra weight to the door. Moreover, there is a risk that a person my bump into an nonselected abutment leg. In this respect, it would be desirable if a door gap apparatus were provided which does not have a plurality of nonselected abutment legs carried by a door-mounted bracket.

U.S. Pat. No. 5,531,490 discloses a security device which provides for a door to be retained in a partially opened condition. With this device, a locking element is mounted in the floor near the bottom of the door. To avoid doing any damage to a portion of a floor located near the bottom of a door, it would be desirable if a door gap apparatus were provided which does not require attachment to a portion of a floor near the bottom of the door.

U.S. Pat. No. 5,581,844 discloses a doorstop that employs a block member attached directly between parts of a door hinge. Great amounts of leverage and force are exerted by a door in the vicinity of a door hinge. If such leverage and force are not carefully controlled, a person may be injured by such leverage and force. To avoid any potentiality of being injured by the leverage an force located in the vicinity of a door hinge, it would be desirable if a door gap apparatus were provided that does not employ components that must be installed directly between hinge components.

Still other features would be desirable in a door gap apparatus. For example, since there may be a number of different reasons why it may be desirable to maintain a door in a partially opened condition, it would be desirable if a kit were provided that easily enables implementation of a partially opened door for a variety of reasons.

More specifically, there may be times when it would be desirable to maintain a partially opened door to allow a pet to enter or exit a room. On the other hand, there may be times when it would be desirable to maintain a partially opened door for purposes of ventilation, while at the same time preventing a pet from entering or exiting a room. At still other times, it would be desirable to maintain a partially opened door so that a person can hear an infant's cries from another room and to provide an opening to observe an infant from another room.

Thus, while the foregoing body of prior art indicates it to be well known to use devices to maintain a door in a partially opened condition, the prior art described above does not teach or suggest a door gap apparatus which has the following combination of desirable features: (1) is not permanently attached to a door; (2) does not require that the apparatus be accurately positioned next to a door hinge; (3) does not have a plurality of nonselected abutment legs carried by a door-mounted bracket; (4) does not require attachment to a portion of a floor near the bottom of the door; (5) does not employ components that must be installed directly between hinge components; (6) easily enables implementation of a partially opened door for a variety of reasons; (7) permits maintaining a partially opened door to allow a pet to enter or exit a room; (8) permits maintaining a partially opened door for purposes of ventilation, while at the same time preventing a pet from entering or exiting a room; and (9) permits maintaining a partially opened door so that a person can hear an infant's cries from another room and to provide an opening to observe an infant from another room. The foregoing desired characteristics are provided by the unique door gap apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a door gap apparatus for mounting on a door and extending from the door to a door frame. The door gap apparatus includes a door clamp which includes a door-edge-covering portion and a pair of door-side clamp portions extending outward from the door-edge-covering portion at opposite edges of the door-edge-covering portion. The door-side clamp portions extend from the door-edge-covering portion in a first direction. Panel clamp members are attached to the door-edge-covering portion. The panel clamp members extend outward from the door-edge-covering portion in a second direction, and the panel clamp members are spaced apart providing a panel-reception region therebetween. A panel portion fits between the panel clamp members. The second direction is perpendicular to the first direction. The panel portion extends in the second direction. The panel portion can be rectangular or triangular in shape to provide a gap between the door and the door frame.

With another embodiment of the invention, the door-side clamp portions includes inwardly curved door-side clamp portions and includes groove-forming panel clamp members, and the panel portion includes tongue-containing panel edges that fit into the groove-forming panel clamp members. The inwardly curved door-side clamp portions can include friction grip members.

With another embodiment of the invention, the door gap apparatus can be in a form of a kit which includes a plurality of relatively long rectangular panel portions, a plurality of complimentary relatively long door-edge-covering portions, a plurality of relatively short rectangular panel portions, a triangular panel portion, and a plurality of complimentary relatively short door-edge-covering portions.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a several preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door gap apparatus which has all of the advantages of the prior art and none of the disadvantages.

It is another object of the present invention to provide a new and improved door gap apparatus which may be easily and efficiently manufactured and marketed.

It is a further object of the present invention to provide a new and improved door gap apparatus which is of durable and reliable construction.

An even further object of the present invention is to provide a new and improved door gap apparatus which is susceptible of a low cost of manufacture with regard to both materials and labor, and which accordingly is then susceptible of low prices of sale to the consuming public, thereby making such door gap apparatus available to the buying public.

Still yet a further object of the present invention is to provide a new and improved door gap apparatus which is not permanently attached to a door.

Still another object of the present invention is to provide a new and improved door gap apparatus that does not require that the apparatus be accurately positioned next to a door hinge.

Yet another object of the present invention is to provide a new and improved door gap apparatus which does not have a plurality of nonselected abutment legs carried by a door-mounted bracket.

Even another object of the present invention is to provide a new and improved door gap apparatus that does not require attachment to a portion of a floor near the bottom of the door.

Still a further object of the present invention is to provide a new and improved door gap apparatus which does not employ components that must be installed directly between hinge components.

Yet another object of the present invention is to provide a new and improved door gap apparatus that easily enables implementation of a partially opened door for a variety of reasons.

Still another object of the present invention is to provide a new and improved door gap apparatus which permits maintaining a partially opened door to allow a pet to enter or exit a room.

Yet another object of the present invention is to provide a new and improved door gap apparatus that permits maintaining a partially opened door for purposes of ventilation, while at the same time preventing a pet from entering or exiting a room.

Still a further object of the present invention is to provide a new and improved door gap apparatus that permits maintaining a partially opened door so that a person can hear an infant's cries from another room and to provide an opening to observe an infant from another room.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 2 is a top view of the first embodiment of the door gap apparatus of the invention shown in FIG. 1.

FIG. 3 is a front edge view of the embodiment of the invention shown in FIG. 2 taken along line 3—3 thereof.

FIG. 6 is a front edge view of another embodiment of the door-edge-covering portion of the invention which includes a number of features inwardly curved door-side clamp portions, friction grip members located in the door-facing sides of said inwardly curved door-side clamp portions, groove-forming panel clamp members for receiving complimentary tongue-containing panel edges.

FIG. 7 is a front edge view of a panel portion having tongue-containing panel edges for receipt between the groove-forming panel clamp members shown in FIG. 6.

DESCRIPTION OF THE PREFERRED EMBODIMENT

With reference to the drawings, a new and improved door gap apparatus embodying the principles and concepts of the present invention will be described.

Figure 1:
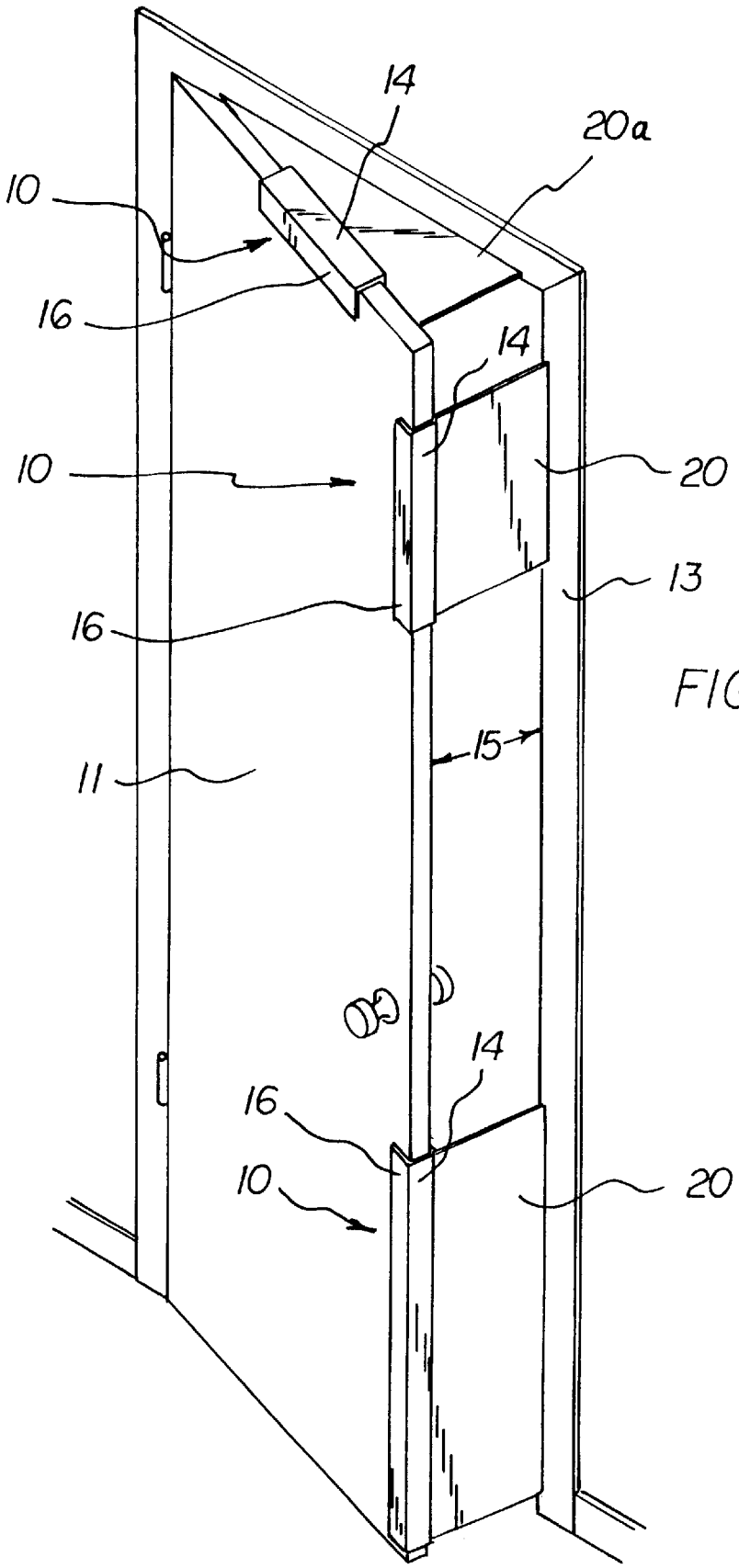
FIG. 1 is a perspective view showing three embodiments of the door gap apparatus of the invention installed on door, wherein the first embodiment is at the top of the door, the second embodiment is below the first embodiment, and the third embodiment is below the second embodiment.
Figure 4:
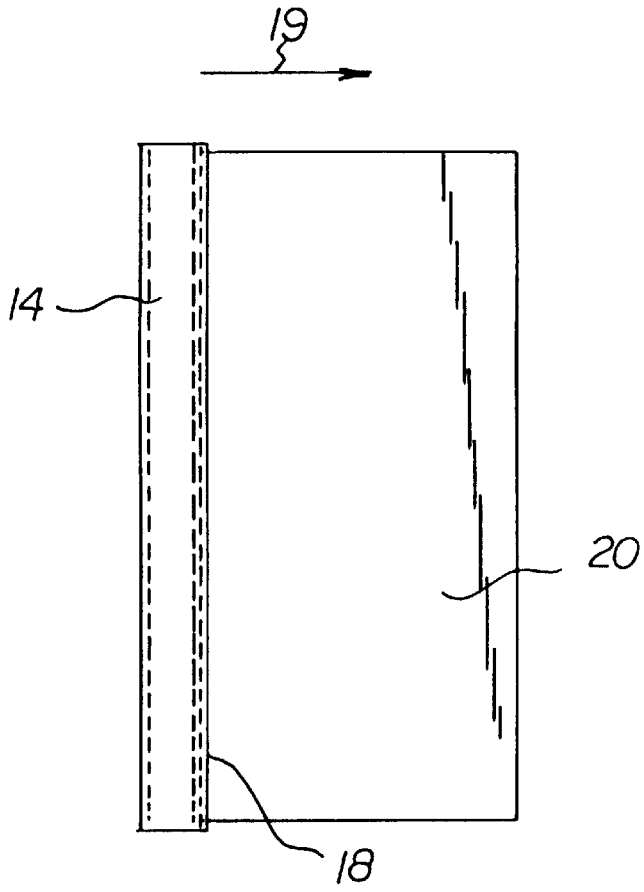
FIG. 4 is a front view of the third embodiment of the invention.
Figure 5:
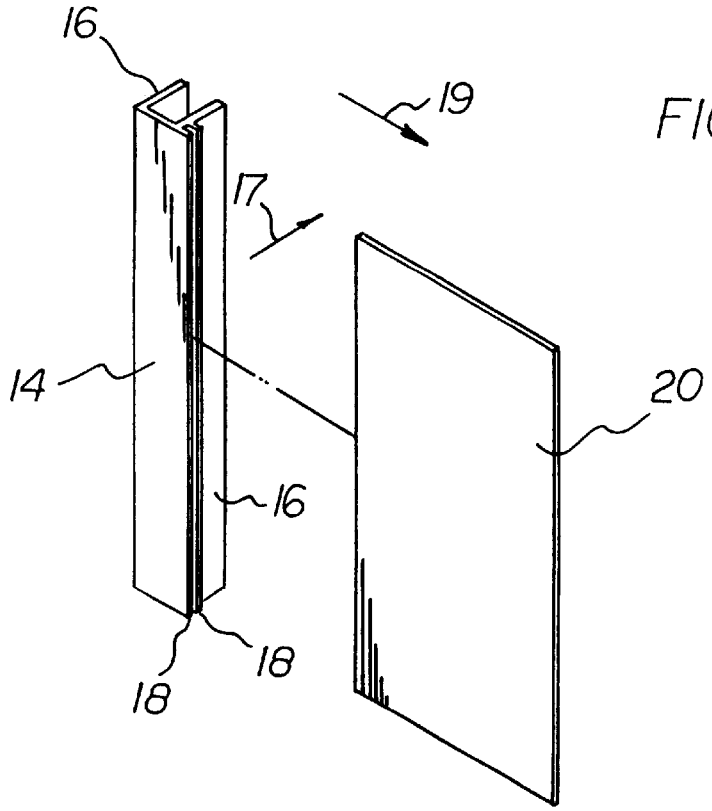
FIG. 5 is an exploded front view of the embodiment of the invention shown in FIG. 4.

Turning to FIG. 1, three embodiments of the invention are shown, and each is designated by reference numeral 10. Generally, a gap apparatus 10 is provided for mounting on a door 11 and extends from the door 11 to a door frame 13. The door gap apparatus 10 includes a door clamp 12 which includes a door-edge-covering portion 14 and a pair of door-side clamp portions 16 extending outward from the door-edge-covering portion 14 at opposite edges of the door-edge-covering portion 14. The door-side clamp portions 16 extend from the door-edge-covering portion 14 in a first direction 17. Panel clamp members 18 are attached to the door-edge-covering portion 14. The panel clamp members 18 extend outward from the door-edge-covering portion 14 in a second direction 19, and the panel clamp members 18 are spaced apart providing a panel-reception region therebetween. A panel portion 20 fits between the panel clamp members 18.

The second direction 19 is perpendicular to the first direction 17. The panel portion 20 extends in the second direction 19. The panel portion 20 can be rectangular or triangular in shape.

The door gap apparatus 10 of the invention can be used in a number of different ways. With the first embodiment of the invention, shown in FIG. 1 as the topmost embodiment, the door-side clamp portions 16 are fitted over the top edge of the door 11, and one edge of the triangular panel portion 20*a* is received in between the respective panel clamp members 18 so that another edge of the triangular panel portion 20*a* rests against the door frame 13. In this way, the triangular panel portion 20*a* keeps a gap 15 between the door 11 and the door frame 13. Because this first embodiment of the invention is placed so high on the door 11, this embodiment of the invention is not readily accessible to children. The presence of the gap 15 permits ventilation through the gap 15. The gap 15 also permits passage of pets through the partially open door 11. Since the door 11 is only partially open, visibility into a room through the gap 15 is limited, thereby increasing privacy even though the door 11 is open. The invention prevents the gap from closing as long as the invention is installed on the door 11.

The second embodiment of the invention, shown in FIG. 1 below the first embodiment, is also located at a relatively high position on the door 11. The door-side clamp portions 16 are clamped onto the front edge of the door 11. The panel portion 20 in this embodiment is rectangular. The rectangular panel portion 20 is also retained between the respective panel clamp members 18 of the second embodiment of the invention. The rectangular panel portion 20 is located between the door clamp and the door frame 13.

The third embodiment of the invention, shown in FIG. 1 below the second embodiment of the invention, extends upward from the bottom of the door 11. The door-side clamp portions 16 are clamped onto the door 11 near the front edge of the door 11. The rectangular panel portion 20 in the third embodiment is longer than the rectangular panel portion 20 in the second embodiment. Such a long rectangular panel portion 20 can effectively block access of pets or small children, while, at the same time, maintaining the gap 15 which provides ventilation and limited visibility.

With the embodiment of the invention shown in FIG. 6, the door-side clamp portions include inwardly curved door-side clamp portions 22 and includes groove-forming panel clamp members 26. The panel portion 20 includes tongue-containing panel edges 28 that fit into the groove-forming panel clamp members 26. The inwardly curved door-side clamp portions 22 can include friction grip members 24. Preferably, the door-side clamp portions 22 are resiliently movable relative to each other so that they may be spread slightly apart when placed on a door edge. Consequently, the ability of the door-side clamp portions 22 to securely grip the door edge and remain in place is enhanced without impairing the ability of same to be easily placed in positioned or removed as desired.

Figure 8:
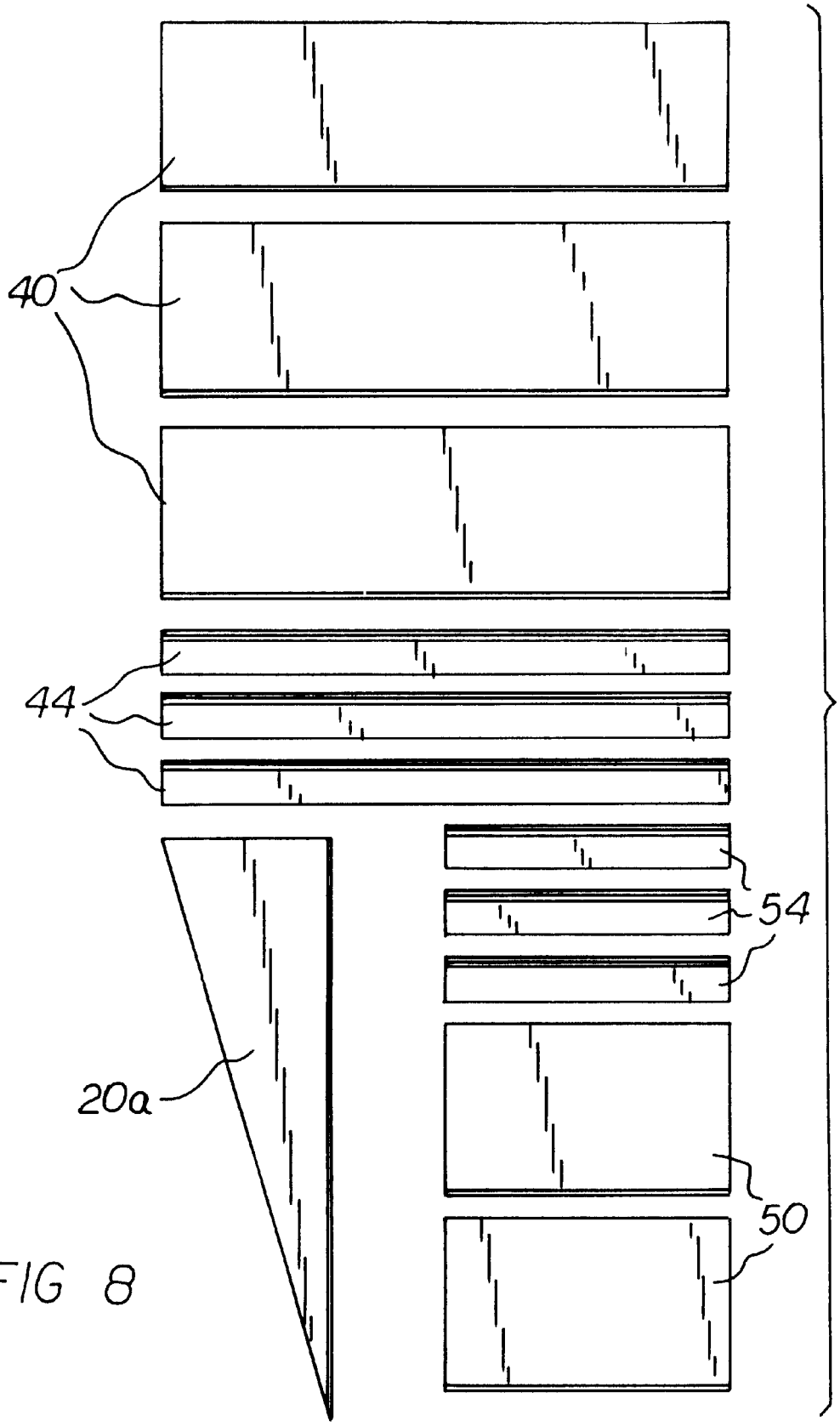
FIG. 8 is a top view of a door gap apparatus of the invention in the form of a kit which includes a plurality of relatively long rectangular panel portions, a plurality of complimentary relatively long door-edge-covering portions, a plurality of relatively short rectangular panel portions, a triangular panel portion, and a plurality of complimentary relatively short door-edge-covering portions.

As shown in FIG. 8, the door gap apparatus can be in a form of a kit which includes a plurality of relatively long rectangular panel portions 40, a plurality of complimentary relatively long door-edge-covering portions 44, a plurality of relatively short rectangular panel portions 50, a triangular panel portion 20*a*, and a plurality of complimentary relatively short door-edge-covering portions 54.

The door gap apparatus 10, especially the components of the kit shown in FIG. 8, can be used in a variety of ways. A use of the door gap apparatus 10 has been described in relation to FIG. 1, discussed above. In addition, with respect to the use of the kit, uses of the kit are shown in FIGS. 9–11.

Figure 9:
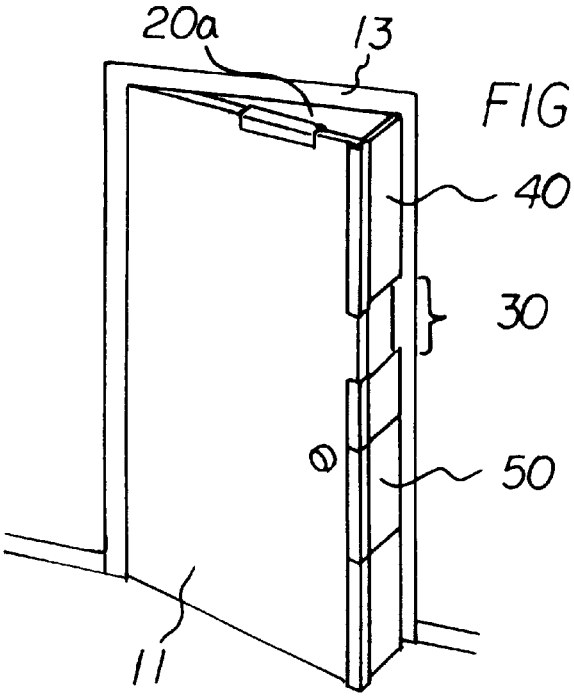
FIG. 9 is a perspective view of the use of an embodiment of the invention to provide a ventilation and sound access gap which is located above a floor, thereby preventing pet access through the door gap at floor level.

In FIG. 9, the kit of the invention can be used to provide a ventilation and sound access gap 30 which is located above a floor, thereby preventing pet access through the door gap at floor level.

Figure 10:
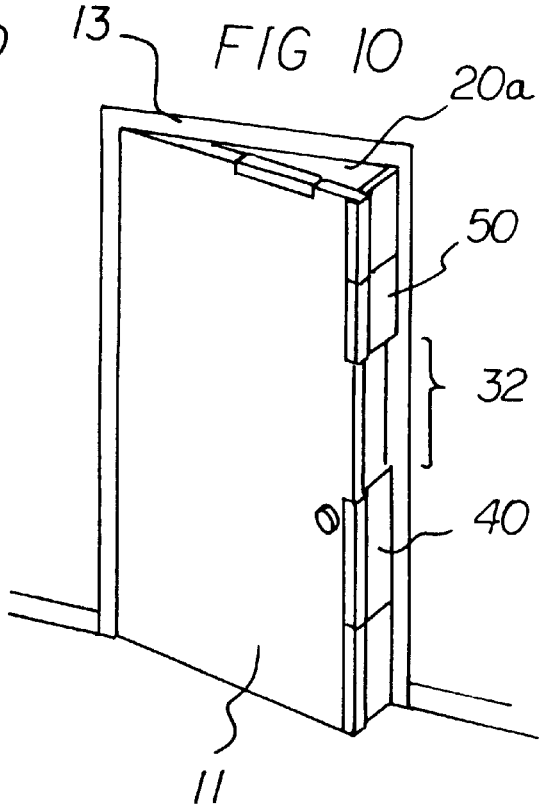
FIG. 10 is a perspective view of the use of an embodiment of the invention to provide an above-floor visible viewing gap which permits a person to look through the visible viewing gap to monitor an infant in a room, wherein the visible viewing gap can also serve as a ventilation and sound access gap.

In FIG. 10, the kit of the invention can be used to provide an above-floor visible viewing gap 32 which permits a person to look through the visible viewing gap to monitor an infant in a room, wherein the visible viewing gap 32 can also serve as a ventilation and sound access gap.

Figure 11:
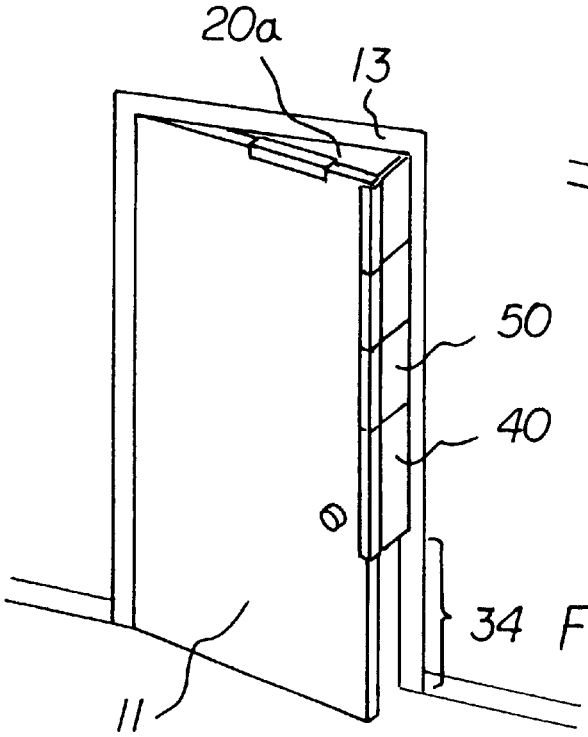
FIG. 11 is a perspective view of the use of an embodiment of the invention to provide a pet access gap which permits a pet to pass through the door gap at floor level while helping to maintain and preserve climate inside a room.

In FIG. 11, the kit of the invention can be used to provide a pet access gap 34 which permits a pet to pass through the door gap at floor level while helping to maintain and preserve climate inside a room.

The components of the door gap apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved door gap apparatus that is low in cost, relatively simple in design and operation, and which may advantageously be used without being permanently attached to a door. With the invention, a door gap apparatus is provided which does not require that the apparatus be accurately positioned next to a door hinge. With the invention, a door gap apparatus is provided which does not have a plurality of nonselected abutment legs carried by a door-mounted bracket. With the invention, a door gap apparatus is provided which does not require attachment to a portion of a floor near the bottom of the door. With the invention, a door gap apparatus is provided which does not employ components that must be installed directly between hinge components. With the invention, a door gap apparatus is provided which easily enables implementation of a partially opened door for a variety of reasons. With the invention, a door gap apparatus is provided which permits maintaining a partially opened door to allow a pet to enter or exit a room. With the invention, a door gap apparatus is provided which permits maintaining a partially opened door for purposes of ventilation, while at the same time preventing a pet from entering or exiting a room. With the invention, a door gap apparatus is provided which permits maintaining a partially opened door so that a person can hear an infant's cries from another room and to provide an opening to observe an infant from another room.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A gap apparatus for mounting on a door and extending from the door to a door frame, comprising:

a door clamp which includes a door-edge-covering portion and a pair of door-side clamp portions extending outward from said door-edge-covering portion at opposite edges of said door-edge-covering portion, wherein said door-side clamp portions extend from said door-edge-covering portion in a first direction, panel clamp members attached to said door-edge-covering portion, wherein said panel clamp members extend outward from said door-edge-covering portion in a second direction, and wherein said panel clamp members are spaced apart providing a panel-reception region therebetween, and a panel portion which fits between said panel clamp members, wherein said apparatus is in a form of a kit which includes a plurality of relatively long rectangular panel portions, a plurality of complimentary relatively long door-edge-covering portions, a plurality of relatively short rectangular panel portions, a triangular panel portion, and a plurality of complimentary relatively short door-edge-covering portions.

2. The apparatus of claim 1 wherein said second direction is perpendicular to said first direction.

3. The apparatus of claim 1 wherein said panel portion extends in said second direction.

4. The apparatus of claim 1 wherein said panel portion is rectangular in shape.

5. The apparatus of claim 1 wherein said panel portion is triangular in shape.

6. The apparatus of claim 1 wherein:

said door-side clamp portions include inwardly curved door-side clamp portions and include groove-forming panel clamp members, and said panel portion includes tongue-containing panel edges that fit into said groove-forming panel clamp members.

* * * * *